US011058195B2

(12) United States Patent
Chrisman

(10) Patent No.: US 11,058,195 B2
(45) Date of Patent: Jul. 13, 2021

(54) LIFE STORY WORK TOOLKIT

(71) Applicant: Theresa Colleen Chrisman, Missouri City, TX (US)

(72) Inventor: Theresa Colleen Chrisman, Missouri City, TX (US)

(73) Assignee: Theresa Colleen Chrisman

( * ) Notice: Subject to any disclaimer, the term of this patent is extended or adjusted under 35 U.S.C. 154(b) by 0 days.

(21) Appl. No.: 16/847,445

(22) Filed: Apr. 13, 2020

(65) Prior Publication Data

US 2020/0281336 A1 Sep. 10, 2020

(51) Int. Cl.

| | |
|---|---|
| ***A45C 11/00*** | (2006.01) |
| ***A45C 5/06*** | (2006.01) |
| ***A45C 13/10*** | (2006.01) |

(52) U.S. Cl.

CPC ..... *A45C 5/06* (2013.01); *A45C 13/103* (2013.01)

(58) Field of Classification Search

CPC ..... A45C 13/103

See application file for complete search history.

(56) References Cited

U.S. PATENT DOCUMENTS

| | | | | |
|---|---|---|---|---|
| 2006/0286606 | A1* | 12/2006 | Oliver | G01N 1/2214 435/7.1 |
| 2015/0096157 | A1* | 4/2015 | Paulick | B42F 9/002 24/67 R |
| 2017/0210002 | A1* | 7/2017 | Turner | G01B 3/1041 |
| 2017/0280868 | A1* | 10/2017 | Campbell, Jr. | A47B 9/20 |
| 2018/0109279 | A1* | 4/2018 | Rana | A45C 13/103 |

* cited by examiner

*Primary Examiner* — Allan D Stevens

(57) ABSTRACT

The present invention contains a select number of tools appropriate for use in creating life story works with older adults in long-term care facilities. The present invention is a portable, well-organized toolkit providing the user with the necessary tools for capturing and preserving older adults' life stories, photos, and/or memorabilia.

4 Claims, 5 Drawing Sheets

LIFE STORY WORK TOOLKIT

BACKGROUND OF THE INVENTION

Field of the Invention

The present invention generally relates to tools for capturing and creating life story work.

Description of Prior Art

Depression is a major concern for residents of nursing homes. Research has shown that the personalization of interventions that allow autobiographical memories to be explored have had significant effects on decreasing depression and improving the quality of life for older adults.

Life story work has been used in a variety of health-care settings to enable people to share their life stories. The premise of life story work is that each person has a story—a personal story with people, feelings, insights, learnings, milestones, circumstances, and actions that define who they are. Life story work is intended to give a person the opportunity to examine their history and capture their life stories into something tangible. This tangible product is a reminder or visual aid of a person's life history. Such products may be in the form of a collage, life story box (containing objects, photographs, and/or documents), digital media format, or a book. It is a concrete, tangible, and ongoing piece of work that can serve to connect an older adult with families and long-term care staff. Life story work involves one person listening (the story catcher) and encouraging another person (the storyteller) to review their life. A life story work typically includes a combination of written material, images of significant individuals, locations or events, and personal memories from the stages of life that the storyteller would like to include. The life story work may be a reminder and/or visual aid of a person's life history.

Older adults in long-term care need to be monitored for any difficulties they may have when creating a life story work or when talking for too long a period of time. A timer may help a story catcher to remain aware and flexible regarding the length of time an older adult is sharing. This may be crucial to adequately accommodate an older adults' needs. There is also a need to have interview questions readily available to support the story catcher and encourage the storyteller in sharing their experiences and memories.

A difficulty for the older storyteller is being able to hear the story catcher. Many older adults in long term care do not have hearing aids so there is a need for a hearing amplifier to assist them in hearing the story catcher's questions. Another difficulty is in the story catcher's ability to hear or understand the storyteller due to any number of factors such as a stroke, lack of teeth, etc. There is a need for a lapel microphone to amplify the storyteller's voice.

The use of an audio recorder to record an older adults' stories frees up a story catcher to attentively listen to a storyteller's stories and respond appropriately. The recordings may be transcribed and created into a life story work. Audio recordings may also help the story catcher to accurately type stories. Adding photos or memorabilia to a life story work usually would entail removing the items from an older adult's room to make a copy or have it scanned. Having a portable scanner accessible to scan precious photos and/or memorabilia, in the presence of the storyteller, would ensure that no photos and/or memorabilia were removed from the storyteller's presence or room.

Residents of long-term care facilities are members of residential communities, so it is often difficult to have privacy. To minimize interruptions while storytelling, a door sign such as "Quiet Please" may bring awareness to other residents and/or staff that story catching was in progress. Long-term care facilities often lack the means to bind the life stories and photos into a cost-effective life story book. Most often the costs to professionally bind a life story book are out of the price range for residents and facilities. An expandable scrapbook album may be a simplified way to construct a life story book. Providing a transcribed audio recording into an electronic format such as a Universal Serial Bus (USB) flash drive may also allow an older adult to add to their story book or make additional copies for family members.

In long-term care facilities, one of the difficulties in creating life story work is possessing the necessary tools and then easily transporting them between residents and/or facilities. Prior systems for the general purpose of providing a person (story catcher) with the necessary tools for capturing and creating a life story work with an older adult were not available. What is needed and what this toolkit provides are life story work tools that are useful, well-organized, and transportable to enable a story catcher to create life story works with older adults living in long-term care facilities.

SUMMARY OF THE INVENTION

We have found that it is possible to provide a toolkit that contains, or may contain, many of the tools necessary to capture and create life story works comprising of two components: a) a multifunction case with a carrying handle; and b) an array of commercially available tools useful or necessary for capturing and creating life story works. Advantageously, the toolkit can be restocked and is convenient for carrying and storing life story work tools. The two components are intended to aid the story catcher in creating a life story work, particularly with older adults living in long-term care facilities.

BRIEF DESCRIPTION OF THE DRAWING

The present invention briefly summarized above will be more fully understood and further benefits will become evident when reference is made to the following detailed description of the invention and the accompanying drawings in which.

DETAILED DESCRIPTION OF THE INVENTION

Figure 1:
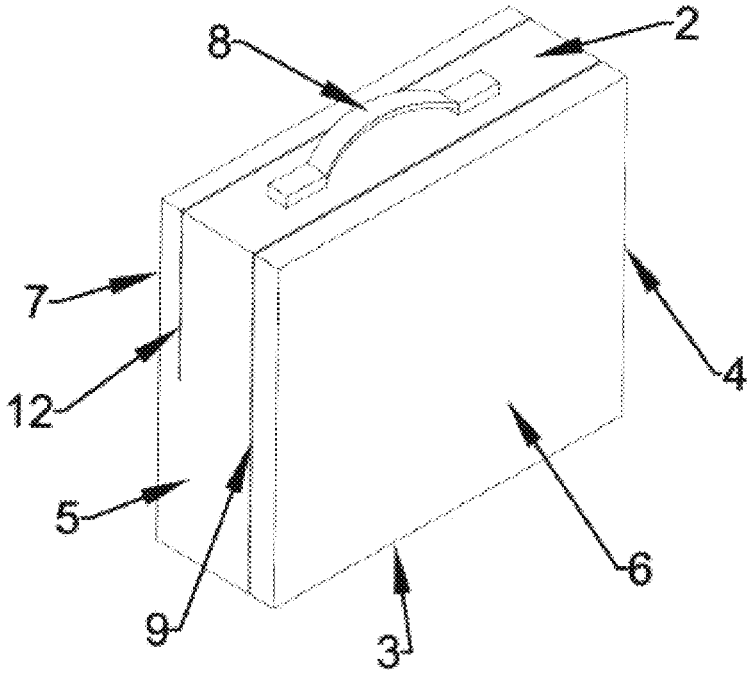
FIG. 1 is a perspective view of the present invention showing the case in the closed position.

Referring to FIG. 1, is a perspective view of the life story work toolkit case which comprises of a top panel 2, a base panel 3, a right panel 4, left panel 5, a front panel 6, and a rear panel 7. The top panel 2, base panel 3, right panel 4, and left panel 5, are generally rectangular in shape and may have a soft side or hard side construction or a combination of both. In the present invention, the embodiment is a double-sided, 2-compartment, zippered tool case; one side's deep compartment 10 is for organizing tools and the other side's deep pocket 13 is for paper and scrapbook storage.

The case can be opened and closed using zippers 9, 12, or any other suitable means of closure so as to protect the contents of the case when the case is closed and not in use. In the present embodiment the marginal edge of the front and rear panels 6 and 7 are opened with zippers 9 and 12, respectively. On front panel 6 the perimeter zipper 9 will typically extend around three of four edges, permitting the front panel 6 to fully fold back to access the deep compartment 10. This is evident in FIG. 2 where front panel 6 is fully folded back. On rear panel 7 the perimeter zipper 12 will typically extend across the top panel 2 and halfway down the right panel 4 and left panel 5 edges to access items in deep pocket 13. This is evident in FIG. 4.

The toolkit case of the present invention is preferably made of lightweight material to enable ease of carrying. In the preferred embodiment, a handle 8 is provided on the top panel 2 which enables the user to carry the toolkit case in a generally horizontal orientation. In an alternative embodiment the toolkit case can be made with wheels on the base panel 3 and an extendable handle on the top panel 2 allowing for wheeled transport of the case.

Figure 2:
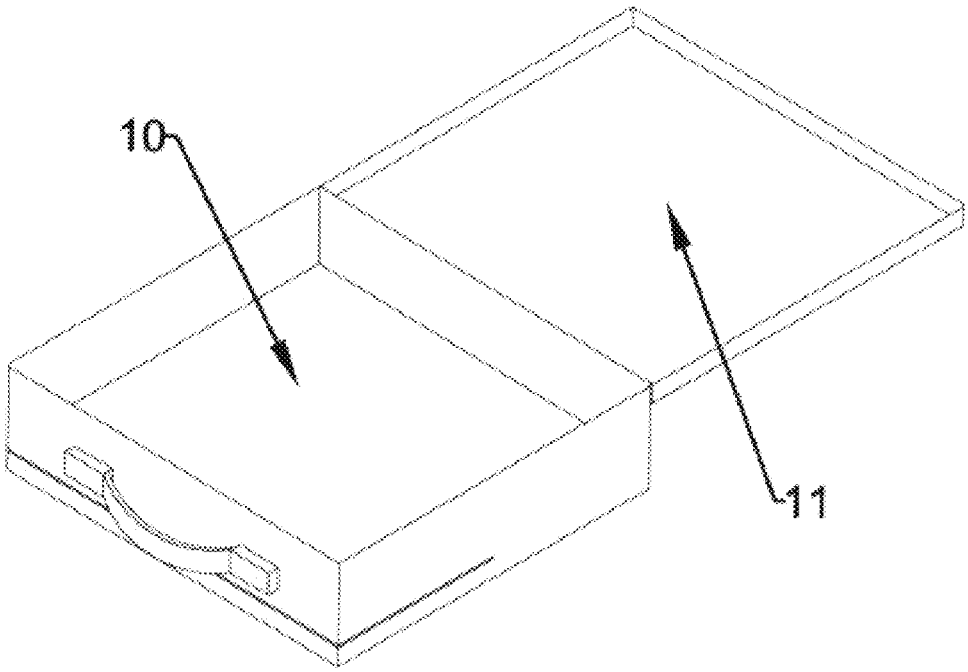
FIG. 2 is a perspective view of the present invention showing the front panel of the case in the open position.
Figure 3:
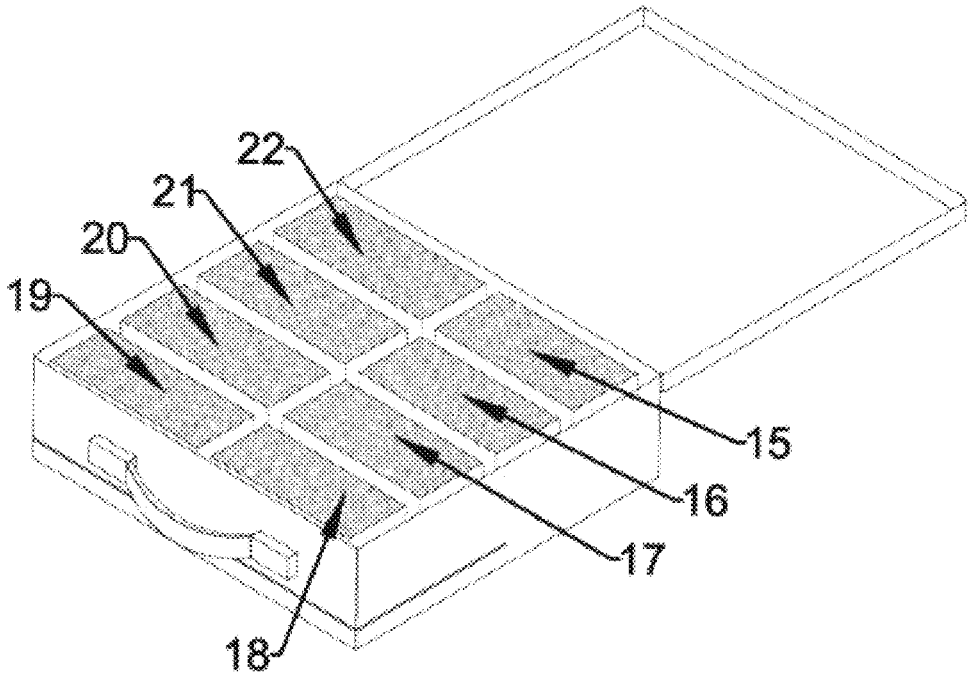
FIG. 3 is a perspective view of the present invention showing the front panel of the case in the open position with an assortment of life story work tools contained therein.

FIG. 2 is a perspective view of the present invention showing the inside surface 11 of front panel 6 of the case in the open position revealing a deep compartment 10 for positioning tools. The tools held in the deep compartment 10 as shown in FIG. 3 are positioned to include at least one, but are not limited to, timer 15; audio recorder 16; portable scanner 17 memory card 18; Universal Serial Bus (USB) Flash Drive 19; lapel microphone 20; personal amplifier with earphone and extra headphones 21; and ink pen 22. In an alternative embodiment, the deep compartment 10 can be made with a sectional organizer for containing the tools.

Figure 4:
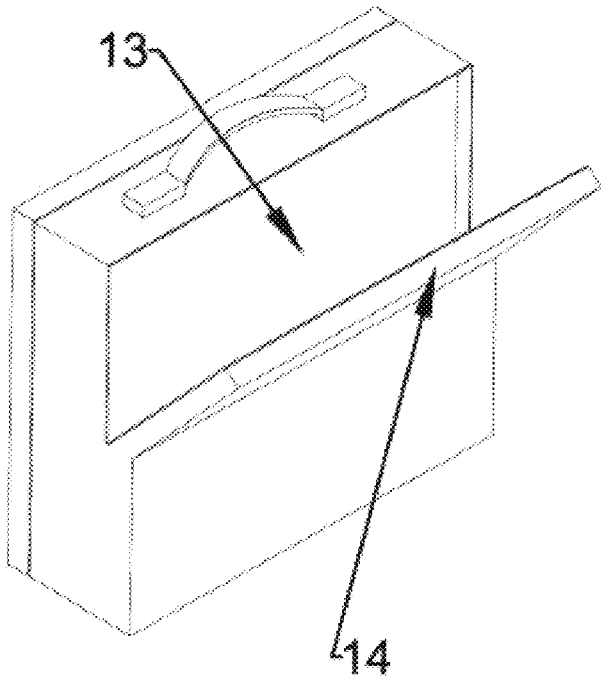
FIG. 4 is a perspective view of the present invention showing the rear panel of the case in the open position.
Figure 5:
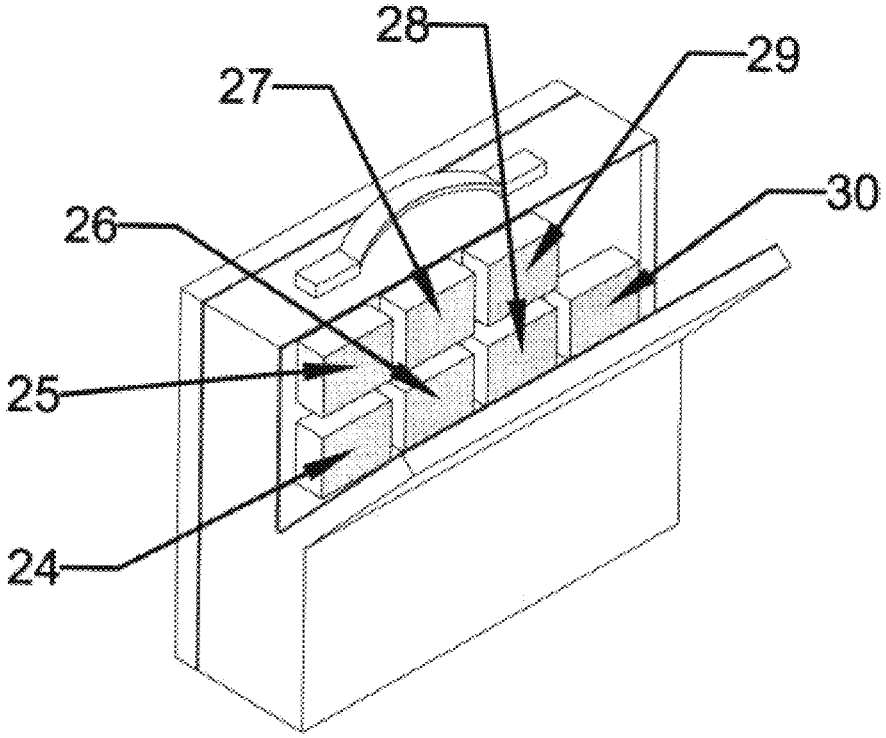
FIG. 5 is a perspective view of the present invention showing the rear panel of the case in the open position with an assortment of life story work tools contained therein.

FIG. 4 is a perspective view of the present invention showing an openable rear panel 14, which is part of rear panel 7 of the case, in the open position having a deep pocket 13 for paper and scrapbook storage. The tools held in the deep pocket 13 are shown in FIG. 5 and are positioned to include at least one, but are not limited to, scrapbook album 24; scrapbook clear sheet protector style page 25; 9×12-inch clipboard 26; 8.5×11-inch pad of lined paper 27; "quiet please" door sign 28; list of sample interview questions 29; set of instructions 30 for the suggested utilization of the contents within the case. In an alternative embodiment the deep pocket 13 can be made with a filing sleeve which may be removed from the case.

What is claimed is as follows:

1. A life story work toolkit comprising:

a case having a top panel, base panel, right panel, left panel, front panel and rear panel; a plurality of life story work tools including at least a timer, audio recorder, portable scanner, memory card enabled to be used in said portable scanner, Universal Serial Bus (USB) Flash Drive, lapel microphone, personal amplifier with earphone and extra headphones, ink pen, scrapbook album, scrapbook clear sheet protector style page, 9×12 inch clip board, 8.5×11 inch pad of lined paper, "quiet please" door sign and a list of sample interview questions; and instructions for the suggested utilization of the life story work tools, wherein the case is configured to hold the life story work tools.

2. The life story work toolkit according to claim 1, wherein the front and rear panels are openable independent of each other, wherein the front panel is enabled to be opened from the top panel to the base panel to reveal a deep compartment, and the rear panel is enabled to be opened from the top panel to halfway down the right and left panels to reveal a deep pocket, said deep compartment and deep pocket configured to at least hold said life story work tools.

3. The life story work toolkit according to claim 1, the case further comprising a carrying handle attached to the top panel.

4. The life story work toolkit according to claim 1, wherein said instructions comprises information for capturing and creating a variety of life story works.

* * * * *